United States Patent [19]

Wynn

[11] 4,249,354

[45] Feb. 10, 1981

[54] REINFORCED INSULATED WALL CONSTRUCTION

[76] Inventor: Gayle B. Wynn, 56 Beech Dr., Edgewood, Ky. 41017

[21] Appl. No.: 17,392

[22] Filed: Mar. 5, 1979

[51] Int. Cl.[3] ..... E04B 2/24

[52] U.S. Cl. ..... 52/438; 52/309.12; 52/439; 52/688

[58] Field of Search ..... 52/309.12, 438, 439, 52/652, 667, 688, 687

[56] References Cited

U.S. PATENT DOCUMENTS

| | | | |
|---|---|---|---|
| 2,714,817 | 8/1955 | Griffiths | 52/688 |
| 3,172,239 | 3/1965 | Larkin | 52/677 |
| 3,289,378 | 12/1966 | Carroll | 52/688 |
| 3,449,879 | 6/1969 | Bloom | 52/437 X |
| 3,471,986 | 10/1969 | Swenson | 52/652 |
| 3,566,568 | 3/1971 | Slobodian | 52/438 X |
| 4,038,798 | 8/1977 | Sachs | 52/438 X |

FOREIGN PATENT DOCUMENTS

| | | | |
|---|---|---|---|
| 2217008 | 10/1972 | Fed. Rep. of Germany | 52/677 |

*Primary Examiner*—Alfred C. Perham
*Attorney, Agent, or Firm*—Thomas J. Slone

[57] ABSTRACT

A reinforced insulated wall construction having a core of thermal insulation material which is reinforced by high-slenderness-ratio reinforced concrete columns. High compressive and side-load strengths are achieved by centrally supporting reinforcing members in vertical passageways in the core while the remainder of each passageway is filled with a concrete slurry and by so centrally supporting the members until the slurry hardens into concrete. Further side-load strength enhancement may be achieved by encasing at least a central length portion of each concrete column in a high flexural strength structural tubular casing.

1 Claim, 9 Drawing Figures

REINFORCED INSULATED WALL CONSTRUCTION

FIELD OF THE INVENTION

This invention relates to providing high strength, highly thermal insulative wall structures for such exemplary applications as energy efficient residential buildings.

BACKGROUND OF THE INVENTION

Insulative wall structures are disclosed for instance in U.S. Pat. No. 4,038,798 which issued Aug. 2, 1977 to Melvin H. Sachs and is titled "Composite Permanent Block-Form For Reinforced Concrete Construction and Method of Making Same". This patent discloses foam filled construction blocks having cardboard-tube-lined vertical passageways. The blocks are integrated into a wall construction by laying a plurality thereof in end-to-end and tiered relation and filling aligned vertical passageways with concrete which may be reinforced by reinforcing bars 64, FIG. 5. As compared to the Sachs construction, the present invention provides such improvements as: means for centrally supporting a reinforcing rod in a long vertical passageway while a concrete slurry is introduced thereinto and until it sets into a concrete column; and a high flexural strength casing which may be disposed at least at the central elevation portion of the passageway. Thus, the present invention comprises means for providing high slenderness ratio concrete columns having high compressive strength, and means for providing an enhanced level of flexural strength relative to the compressive strength of the columns for particular applications rather than providing excessive compressive strength to achieve a satisfactory level of side load strength in wall constructions comprising such columns.

U.S. Pat. No. 3,566,568 which issued Mar. 2, 1971 to Joseph Slobodian also discloses cellular blocks having vertical passageways in which reinforced concrete columns are formed in situ. This patent shows reinforcing rod retaining plate 23, FIGS. 1 and 4, for positioning the top end of a reinforcing rod 25 in each passageway but no means for centrally positioning or supporting the rod 25 in the passageway along its length while a concrete slurry sets up in the passageway.

U.S. Pat. No. 3,562,985 which issued Feb. 16, 1971 to J. A. Nicosia discloses yet another foam filled wall construction having vertically extending passageways therethrough. Nicosia does not, however, provide reinforced concrete columns to strengthen his construction as provided by the present invention.

While the prior art patents discussed above disclose some of the features of the present invention as described and shown herein, it is believed they fail both singly and collectively to teach, disclose, or suggest the present invention. They fail, for instance, to disclose such features of the present invention as spacing means for positively assuring that a reinforcing rod is supported and positioned axially in a high slenderness ratio concrete column, and means for significantly enhancing both the compressive strength and flexural strength of a wall comprising high slenderness ratio concrete columns without increasing the diameter of the columns; for instance, by encasing at least a central elevational portion of each column in a high flexural strength tubular casing.

SUMMARY OF THE INVENTION

A reinforced insulated wall construction comprising a core of thermal insulation material disposed between sheets of facing material. The core has a plurality of vertically extending passageways formed therein. A high slenderness ratio reinforcing member is provided in each passageway and means are provided for positioning and supporting a reinforcing member axially in each passageway. The remainder of each passageway is filled with and the reinforcing member is encased in concrete to form a concrete column. The means for positioning said reinforcing members may comprise radially extending and longitudinally spaced spacer members disposed intermediate the inside wall of a passageway and its associated reinforcing member. The passageways may be lined with tubular members having substantially greater hoop strength than the core material. At least a central elevational portion of each concrete column may be encased in a high flexural strength tubular casing to increase the compressive and side load strength of the wall construction comprising such columns.

BRIEF DESCRIPTION OF THE DRAWINGS

While the specification concludes with claims particularly pointing out and distinctly claiming the subject matter regarded as forming the present invention, it is believed the invention will be better understood from the following description taken in conjunction with the accompanying drawings in which:

DESCRIPTION OF A PREFERRED EMBODIMENT

Figure 1:
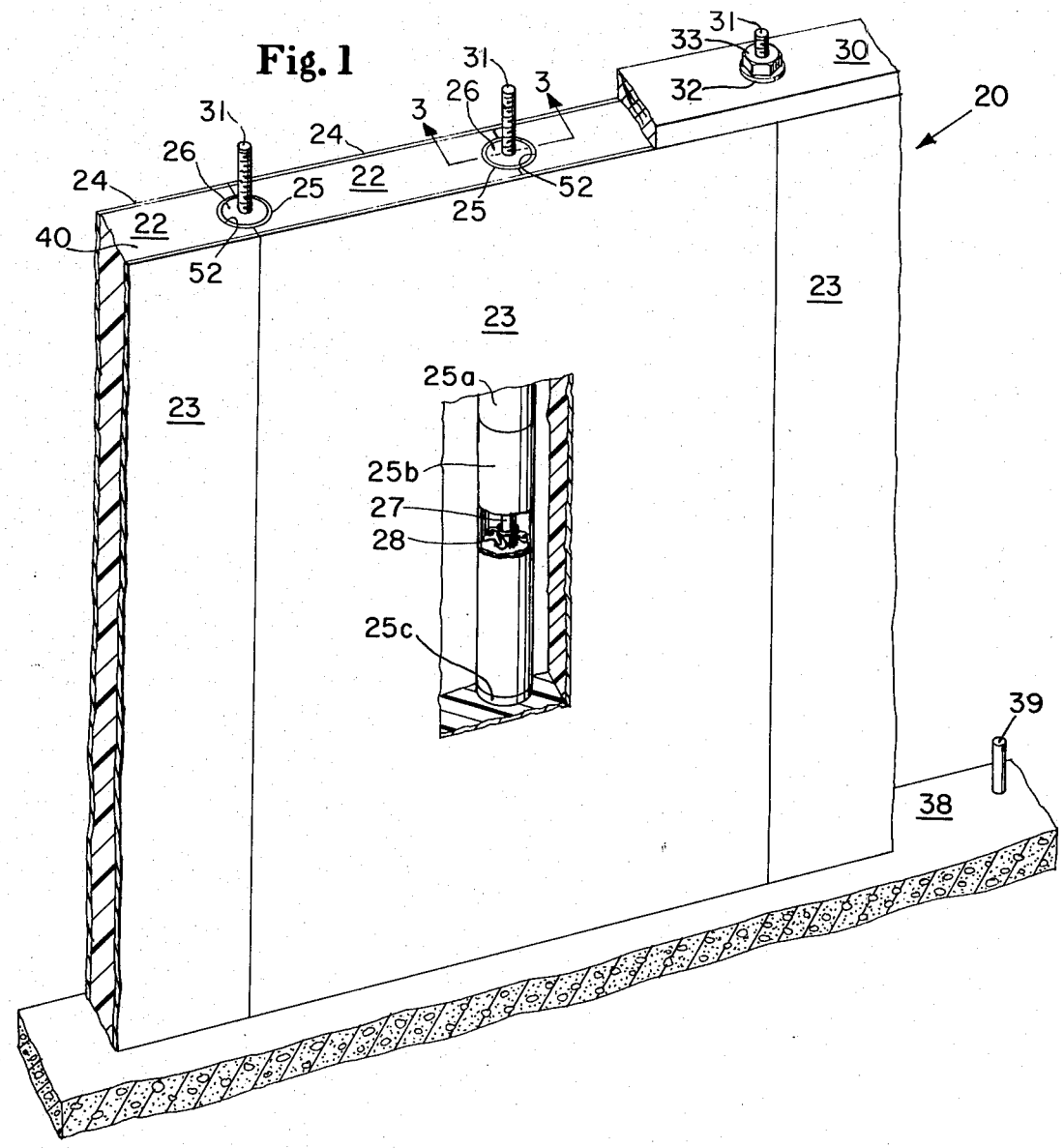
FIG. 1 is a fragmentary, partially torn away perspective view of a wall construction embodying the present invention.

Referring now to the drawings in which, from view to view, identical or nearly identical features are designated by the same designators, FIG. 1 shows in perspective a fragmentary portion of a preferred wall construction 20 embodying the present invention. Wall construction 20, hereinafter referred to as wall 20, comprises core member 22 facing members 23 and 24, tubular liners 25 comprising liner segments 25*a*, and 25*b*, and 25*c*, concrete fillings 26, reinforcing rods 27, radial spacers 28, plate 30, and plate securement means which may include threaded fitments 31, washers 32, and nuts 33. The concrete fillings 26, reinforcing rods 27, and radial spacers 28 are collectively referred to hereinafter as columns 35. As further indicated in FIG. 1, the bottom end of wall 20 is keyed to subjacent structure such as a concrete footer or slab 38 (or foundation wall not shown) at spaced intervals by stub reinforcing rods 39 which are imbedded in the subjacent structure and one of which rods extend upwardly into the bottom ends of each column 35. As still further indicated in FIG. 1, the threaded fitments 31, washers 32 and nuts 33 provide representative means for securing plate 35 to the composite top surface 40 of wall 20. Preferably plate 30 comprises wood which will conform to surface 40 when stressed by superjacent loading forces. Also, when plate 30 is made of wood, it provides a convenient nailing surface for superjacent wooden framing members such as joists, studs, rafters, and the like. Among other functions, plate 30 ties segments of wall 20 together so that wall 20 has adequate tensile strength and side load (wind resisting) strength. That is, the plate 30 functions in part to integrate the segments of wall 20 into a structurally integrated and responsive entity. By way of analogizing to the human anatomy, plate 30, columns 35 and stud reinforcing rods 39 and subjacent coherent structure act corporately to provide skeletal strength; and core members 22 and facing members 23 and 24 act corporately as the tissue and skin, respectively, of wall 20.

Preferably, for example, walls 20 for conventional residential buildings may include core members 22 comprising structurally self-supporting batts of a substantially rigid, highly thermally insulative material such as foamed or expanded polystyrene which batts are about six inches thick and have widths and lengths of about two feet by eight feet, respectively. Also, facing members 23 and 24 are preferably sheet aluminum which is about one-sixteenth-inch thick, and which members have widths and lengths of about four by eight feet, respectively. Alternatively, the core members 22 and the facing members 23 and 24 may be provided in lengths equal to the heights of completed wall portions which may vary, for instance, in contemporary style structures.

Figure 2:
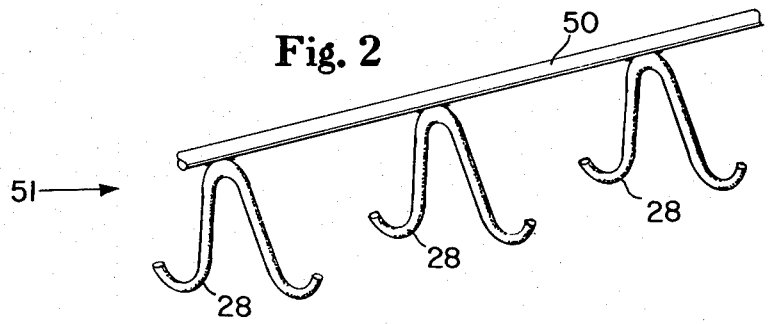
FIG. 2 is an enlarged scale, fragmentary perspective view of a reinforcing bolster which may be incorporated in embodiments of the present invention.

Two such core members 22 are preferably placed in side-by-side relation and adhesively sandwiched between one facing member 23 and one facing member 24 to form a modular wall subassembly. Prior to being thus sandwiched, both of the vertically extending sidefaces of each core member 22 are semicylindrically channeled to facilitate insertion of liner segments 25*a*, 25*b*, and 25*c* on the job site after a plurality of the modular wall subassemblies have been erected in abutting relation with each other and indexed with the stub reinforcing rods 39 as shown in FIGS. 1 and 2.

Liner segments 25*a*, 25*b*, and 25*c* are disposed in end-to-end relation when inserted into the vertically extending passageways in and intermediate cores 22, and act corporately to form liners 25 for encasing concrete columns 35. The liner segments must have sufficient hoop strength, in combination with the strength of cores 22, to contain a concrete slurry until the slurry sets. Suitable materials from which liner segments 25*a*, 25*b*, and 25*c* may be made include extrusion formed thermoplastic tubing: for instance, polyvinylchloride (PVC). Preferably, however, liners 25*b* comprise material having relatively great flexural strength so that columns 35 are reinforced in their central elevational portions; their portions most highly stressed under normal loads and in which portions structural column failures are prone to begin. Thus, the columns are substantially protected from structural failure by encasing only their central elevational portions in high strength casings rather than encasing the entire columns in high strength casings . This effects a substantial savings of high strength casing material to achieve a given level of strength. Exemplary liner segments 25*b* include, for instance, iron and steel tubing.

Wall 20, FIG. 1, is preferably completed on the job site by inserting a reinforcing rod 27 into each passageway lined by liner segments 25*a*, 25*b*, and 25*c* after fastening a threaded fitment 31 to the top end of the rod 27, and securing a plurality of radial spacers 28 to the rod 27 in longitudinally spaced relation. Then, the remainder of each liner 25 is filled with concrete which, when set, encases the rod 27 and radial spacers 28 to form a reinforced concrete column 35.

The radial spacers 28 preferably are formed from iron or steel wire, and may be secured in a predetermined spaced relation by, for instance, being welded directly to an iron reinforcing rod 27. Alternatively, as shown in FIG. 2, a predetermined group of radial spacers 28 may be secured as by welding to a runner 50 to form a radial spacer subassembly 51. Such subassemblies are commercially available in a variety of sizes and gauges, and are known in the reinforced concrete business as bolsters. Such bolsters of predetermined lengths can be secured to a reinforcing rod in predetermined relation by any suitable means such as by being wired together or by welding as discussed more fully hereinafter.

A fragmentary portion of wall 20 is shown in sectional view 3 taken along line 3—3 of FIG. 1. In this view, liner segments 25*a*, 25*b*, and 25*c* are indicated as having lengths La, Lb and Lc, respectively. In embodiments of wall 20 having lower strength requirements, element 25*b* may be made from the same material as 25*a* and 25*c*. Alternatively, liner 25 may be a unitary member rather than segmented. Moreover, of course, in the event other means are provided for containing concrete slurry to form columns 35, liner 25 may be omitted. Such means may include but not be limited to making cores 22 of material having sufficient strength to so contain concrete slurry.

Figure 3:
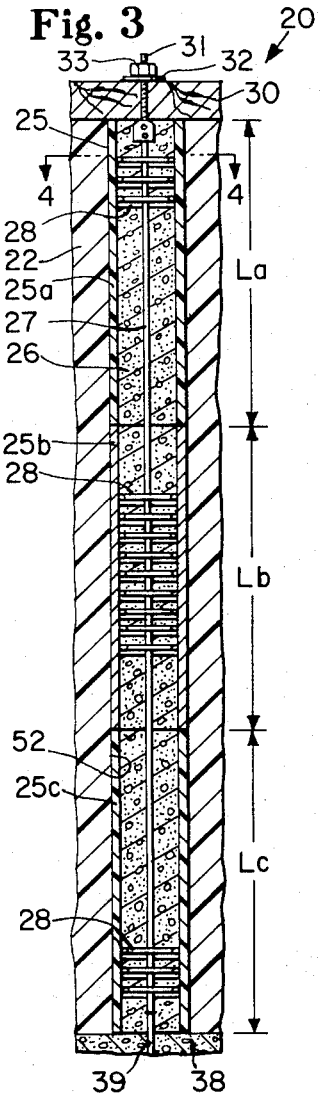
FIG. 3 is a fragmentary sectional view taken along line 3—3 of FIG. 1.

As also shown in FIG. 3, radial spacers 28 are shown to be disposed in three groups: relatively small groups of six spacers 28 each which are disposed near but recessed from the top and bottom ends of liner 25; and a relatively large group of eighteen spacers 28 disposed along the central elevational length portion of reinforcing rod 27. Such a grouping has been found to assure that, for instance, a one-half-inch diameter reinforcing rod having a length of from about eight to about ten feet is substantially axially aligned and supported in liner 25 throughout its length. By having the top group of spacers 28 spaced below the entrance to liner 25, the introduction of a concrete slurry into the top of liner 25 is relatively unobstructed.

Figure 4:
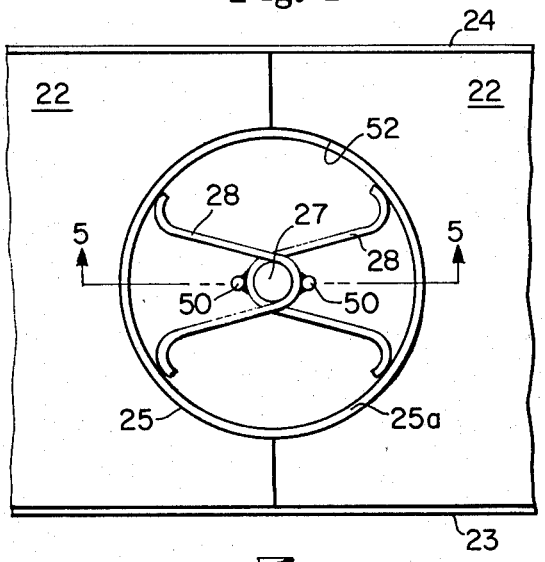
FIG. 4 is an enlarged scale, fragmentary plan view of the wall construction shown in FIG. 2, taken along line 4—4 thereof.

FIG. 4 is an enlarged scale sectional view of a fragmentary portion of a wall 20 which view is taken along line 4—4 of FIG. 3 but in which view the concrete and some section lines have been omitted for clarity. FIG. 4 clearly shows two cores 22 in abutting relation with each other, and sandwiched between facing members 23 and 24. The edges of the cores 22 are semi-cylindrically grooved to form a cylindrical passageway 52 for acceptance of liner 25; either unitary or segmented. FIG. 4 further shows that the radial spacers 28 are elements of bolsters such as shown in FIG. 2 and described hereinabove.

Figure 5:
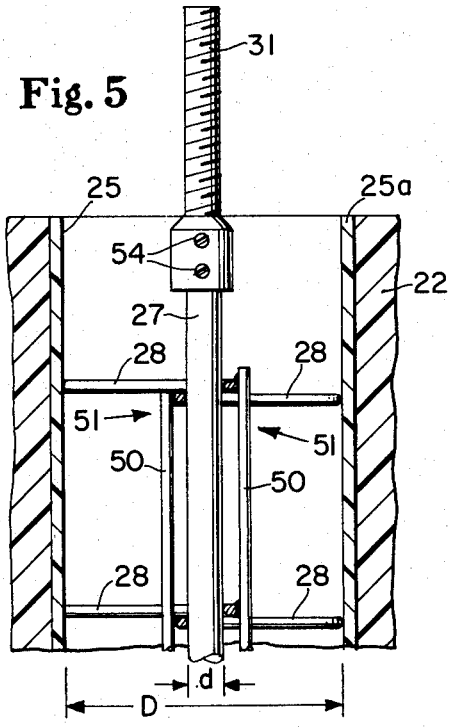
FIG. 5 is a fragmentary sectional view taken along line 5—5 of FIG. 4.

FIG. 5 is a fragmentary sectional view taken along line 5—5 of FIG. 4 to more clearly show the disposition of the spacers 28 and runners 50 of bolsters 51; the recessed relation of the topmost radial spacer 28 below the top end of liner 25; and a representative means for attachment of a threaded fitment 31 to the top end of rod 27 which representative means includes set screws 54. Alternatively, a threaded fitment may be secured by other means not shown; for instance, by welding. Yet another alternative would be to thread the top end of rod 27 to accept nut 33, FIGS. 1 and 2, and to make rod 27 long enough to extend through plate 30 as described hereinbefore with respect to threaded fitment 31.

Figure 6:
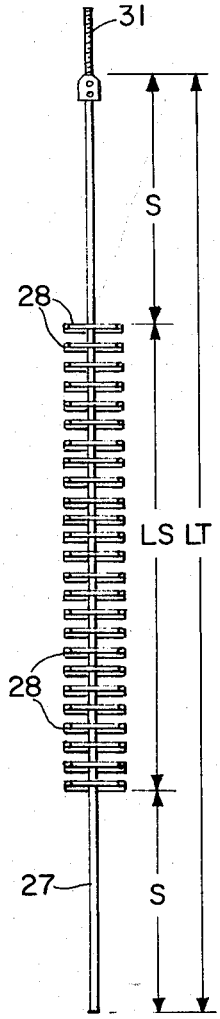
FIG. 6 is a side elevational view of an alternate arrangement of radially extending, longitudinally spaced spacer members on a high-slenderness-ratio concrete reinforcing rod.

FIG. 6 is a side elevational view of an alternative reinforcing rod assembly comprising rod 27, radial spacers 28, and threaded fitment 31. As compared to the configuration shown in FIG. 3, a relatively large group of spacers 28 are disposed in longitudinally spaced relation along the centrally elevational length portion LS of rod 27 having a length designated LT. Such a grouping wherein LS is about one half LT has been found, for instance, to effectively assure axial alignment of such a reinforcing rod assembly in a liner 25 when the rod 27 was iron concrete reinforcing rod having a length LT to diameter d ratio of about 240:1 and wherein the ratio of the diameter D of the liner 25 to the diameter d of the rod 27 was about 8:1.

Figure 7:
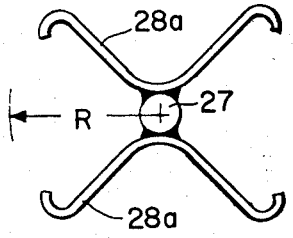
FIGS. 7 through 9 are end views of concrete reinforcing rods having alternate configurations of radially extending spacers secured thereon.
Figure 8:
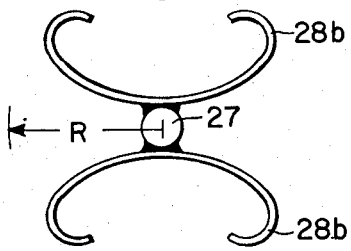

FIGS. 7 and 8 show two alternative configuration radial spacers 28*a* and 28*b*, respectively, which are shown to be welded directly to reinforcing rods 27. In such assemblies, their effective radii R are equal to about one half the diameter D of the liner 25 into which it is intended they will be inserted. Some springiness of the cantilevered portions of spacers 28*a* and 28*b*, and or a reasonably degree of deformability by hand enable the tolerances between R and D to be quite large while still insuring the axial alignment function of the radial spacers; that is to assure that rod 27 is axially aligned in a liner 25 when inserted thereinto.

Figure 9:
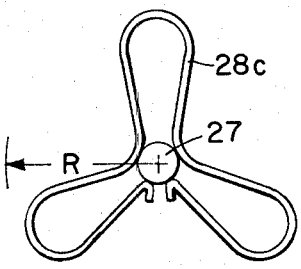

FIG. 9 is a view of yet another alternate embodiment, three-leaf-clover-shape radial spacer 28*c* which is adapted to be retained on rod 27 by its springiness rather than by welding. Thus, a plurality of spacers 28*c* can conveniently be disposed along the length of rod 27 at any desired spacing. This enables job site assembly without the need for welding as would be required for the configurations shown in FIGS. 7 and 8.

REINFORCED CONCRETE COLUMNS

The following examples describe the preparation, geometry, and testing of four ten (10) foot high reinforced concrete columns of the type which are incorporated in wall embodiments of the present invention. That is, reinforced concrete columns which were made by inserting a ten (10) foot long length of No. 4 (approximately one-half inch diameter) reinforcing rod into a ten (10) foot long length of four (4) inch diameter PVC pipe. The reinforcing rod was centered in the pipe by sections of bolsters of the type shown in FIG. 2 which bolsters had radial spacers 28 and runners 50 made from iron wire having a diameter of about three-sixteenths (3/16) inch, and on which runners 50 the radial spacers were spaced at about two-and-one half inch intervals. The bolster sections were wired onto the reinforcing rod in the overlapping relation indicated in FIGS. 4 and 5, and were positioned along the length of the rod as stated under the specific Examples.

EXAMPLE I

A first sample column was constructed and tested as follows. Bolster sections as described above were positioned at the top, middle, and bottom of a rod 27 as indicated in FIG. 3. The top and bottom bolster sections were about six (6) inches long, and the middle bolster section was about twelve (12) inches long. The concrete mix was three thousand pounds per square inch design mix concrete. The sample weighed about one-hundred-forty pounds.

The column was tested by applying axial load with a jack using a steel frame for the reactions. The sample was restrained against lateral movement at one-half inch from the top end, and within about two-and-one-half inches of the bottom end. Pine wood blocks (simulated plate 30) were used at both ends to provide uniform seating of the loading blocks and to prevent localized failure at the column ends due to rough concrete surfaces. The sample was loaded until failure occurred which was manifested by rather precipitious buckling. This column was found to have a yield point of about eleven-thousand-four-hundred (11,400 ) pounds, and an ultimate load of about thirteen-thousand-two-hundred (13,200) pounds.

EXAMPLE II

A second sample column was constructed and tested as described above except its reinforcing rod was centrally-axially supported by bolster sections five (5) feet long which were secured about the middle elevational portion of the ten-foot long rod as generally indicated in FIG. 6. Thus, the top and bottom two-and-one-half-foot lengths of the reinforcing rod were positioned by the stiffness of the rod extending from the bolster positioned central portion of the rod. This sample weighed about one-hundred-forty-three (143) pounds. Its yield point was determined to be fourteen-thousand-four-hundred (14,400) pounds, and its ultimate strength was determined to be sixteen-thousand-three-hundred (16,300) pounds.

EXAMPLE III

A third sample column was constructed and tested as described above except its reinforcing rod was centrally-axially supported by four bolster sections having uniform six (6) inch lengths and positioned at the top and bottom ends of the rod and at equally spaced intermediate elevations. This sample weighed about one-hundred-forty (140) pounds. Its yield point was determined to be ten-thousand (10,000) pounds, and its ultimate strength was determined to be fourteen-thousand-two-hundred (14,200) pounds.

While all of the sample columns described in the above 3 Examples are believed to have substantially greater strength than similar columns not having bolsters for positioning the reinforcing rod, it is believed that the greater concentration of the radial spacers about the central length portion of the reinforcing rod as described in Example II provides substantially greater column strength than the other two Examples wherein the spacers were not so concentrated in the middle portion of the columns.

EXAMPLE IV

A fourth sample column was constructed which was identical to Example II above except the fourth sample was made from four-thousand-pound-per-square-inch concrete mix. It weighed about one-hundred-forty-seven (147) pounds. Its yield point was determined to be eighteen-thousand-two-hundred (18,200) pounds, and its ultimate strength was determined to be twenty-thousand (20,000) pounds. Thus, the strength of sample number four was substantially greater than of sample number two.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. A reinforced insulated wall construction which is reinforced by high slenderness ratio reinforced concrete columns, said construction comprising a first sheet and a second sheet of facing material disposed in spaced relation, a core of thermal insulation material disposed intermediate said sheets, said core having a plurality of vertically extending, laterally spaced passageways provided therein, a tubular liner disposed in each said passageway, said liner having only about its central elevational one third length portion comprised of a relatively high flexural strength tubular form, an elongate, high-slenderness-ratio reinforcing member disposed in each said tubular liner, said reinforcing member having a relatively small transverse cross section relative to said tubular liner, means for axially positioning said member in said passageway throughout its length, said means for axially positioning said reinforcing member comprising a plurality of longitudinally spaced radially extending spacer elements, said reinforcing members and said spacer elements being encased by and said tubular liners being filled with concrete.

* * * * *